US010179084B2

(12) United States Patent
Lin

(10) Patent No.: US 10,179,084 B2
(45) Date of Patent: Jan. 15, 2019

(54) MASSAGE APPARATUS HAVING MASSAGE PRESSURE SENSING AND ADAPTING DEVICE MECHANISM

(71) Applicant: Xinqiang Lin, Fujian (CN)

(72) Inventor: Xinqiang Lin, Fujian (CN)

(73) Assignee: Xiamen Mas-Agee Electronic Technology Co., Ltd., Fujian (CN)

( * ) Notice: Subject to any disclaimer, the term of this patent is extended or adjusted under 35 U.S.C. 154(b) by 906 days.

(21) Appl. No.: 14/419,538

(22) PCT Filed: Jul. 30, 2013

(86) PCT No.: PCT/CN2013/080378
§ 371 (c)(1),
(2) Date: Feb. 4, 2015

(87) PCT Pub. No.: WO2014/026539
PCT Pub. Date: Feb. 20, 2014

(65) Prior Publication Data

US 2015/0182411 A1 Jul. 2, 2015

(30) Foreign Application Priority Data

Aug. 13, 2012 (CN) ..... 2012 2 0401750 U

(51) Int. Cl.
*A61H 15/00* (2006.01)
*A61H 7/00* (2006.01)

(52) U.S. Cl.
CPC ..... *A61H 15/0078* (2013.01); *A61H 7/007* (2013.01); *A61H 2015/0028* (2013.01);
(Continued)

(58) Field of Classification Search
CPC ..... A61H 15/0078; A61H 7/007; A61H 2201/1409; A61H 2201/5071;
(Continued)

(56) References Cited

U.S. PATENT DOCUMENTS 3,939,826 A * 2/1976 Fujimoto ..... A61H 23/0254 601/111
4,009,710 A * 3/1977 Inada ..... A61H 15/0078 601/108
(Continued)

FOREIGN PATENT DOCUMENTS

CN 2857932 Y 1/2007
CN 101222897 A 7/2008
(Continued)

*Primary Examiner* — Rachel T Sippel
*Assistant Examiner* — Tu Vo
(74) *Attorney, Agent, or Firm* — Rosenberg, Klein & Lee

(57) ABSTRACT

A massage apparatus is provided with a movable base frame at the bottom, a massage mechanism and a pressure sensing and adapting drive mechanism. The massage mechanism and the pressure sensing and adapting drive mechanism are provided on the movable base frame. The massage mechanism has a left and a right clamp plate, a linking post, a malaxation part and a pummelling part. The left and right clamp plates are fixedly provided on the movable base frame, and the malaxation part and the pummelling part are provided between the left and right clamp plates. The massage apparatus automatically senses the massage pressure and automatically adjusts the massage pressure in real-time within a provided pressure range according to the different body types of users. The massage apparatus automatically adapts to changes in the height and the curvature of the back of the human body in the course of massaging.

2 Claims, 2 Drawing Sheets

(52) U.S. Cl.
CPC ..... *A61H 2201/0142* (2013.01); *A61H 2201/0149* (2013.01); *A61H 2201/1215* (2013.01); *A61H 2201/1409* (2013.01); *A61H 2201/1427* (2013.01); *A61H 2201/1623* (2013.01); *A61H 2201/1654* (2013.01); *A61H 2201/1669* (2013.01); *A61H 2201/1678* (2013.01); *A61H 2201/5061* (2013.01); *A61H 2201/5071* (2013.01); *A61H 2205/081* (2013.01); *A61H 2230/855* (2013.01)

(58) Field of Classification Search
CPC ..... A61H 2205/081; A61H 2230/855; A61H 2201/1678; A61H 2201/1215; A61H 2201/0142; A61H 2201/1654; A61H 2201/0149; A61H 2201/1669; A61H 2201/506; A61H 2201/1427; A61H 2201/1623; A61H 2015/0028; A61H 7/00; A61H 7/001; A61H 7/002; A61H 7/004; A61H 7/008; A61H 2007/009; A61H 2201/0138; A61H 2201/1418; A61H 15/00; A61H 2015/0007; A61H 2201/50; A61H 2201/5002; A61H 2201/5051; A61H 2201/5056; A61H 2201/5053; A61H 2201/5058
See application file for complete search history.

(56) References Cited

U.S. PATENT DOCUMENTS 5,792,080 A * 8/1998 Ookawa ..... A61H 1/00 601/102
6,832,991 B1 * 12/2004 Inada ..... A61H 39/04 601/100
7,029,453 B2 * 4/2006 Chen ..... A61H 15/0078 601/100
2001/0004679 A1 * 6/2001 Ichikawa ..... A61H 7/001 601/98
2003/0032903 A1 * 2/2003 Kasai ..... A61H 1/00 601/99
2003/0216673 A1 * 11/2003 Miki ..... A61H 15/00 601/99
2003/0216674 A1 * 11/2003 Miki ..... A61H 15/00 601/99
2004/0122343 A1 * 6/2004 Mori ..... A61H 15/0078 601/99
2004/0183345 A1 * 9/2004 Furuie ..... A61H 15/0078 297/217.1
2004/0186398 A1 * 9/2004 Furuie ..... A61H 15/0078 601/99
2005/0010144 A1 * 1/2005 Chen ..... A61H 15/0078 601/99
2005/0090770 A1 * 4/2005 Chen ..... A61H 15/0078 601/99
2005/0090771 A1 * 4/2005 Miki ..... A61H 15/0078 601/99
2005/0096571 A1 * 5/2005 Miki ..... A61H 15/0078 601/99
2005/0101890 A1 * 5/2005 Mizoguchi ..... A61H 1/00 601/84
2005/0192520 A1 * 9/2005 Morita ..... A61H 7/00 601/99
2006/0111653 A1 * 5/2006 Nishio ..... A61H 7/001 601/84
2007/0149907 A1 6/2007 Ting et al.
2007/0239089 A1 * 10/2007 Chiu ..... A61H 7/007 601/99
2008/0125683 A1 * 5/2008 Chen ..... A61H 15/0078 601/134
2009/0177128 A1 * 7/2009 Fukuyama ..... A61H 7/001 601/98
2010/0198120 A1 * 8/2010 Tago ..... A61H 1/0237 601/134

FOREIGN PATENT DOCUMENTS

CN 101711717 A 5/2010
CN 101744708 A 6/2010
CN 202776940 U 3/2013

* cited by examiner

MASSAGE APPARATUS HAVING MASSAGE PRESSURE SENSING AND ADAPTING DEVICE MECHANISM

TECHNICAL FIELD OF THE INVENTION

The present invention relates to a massage apparatus, and more particularly, to a massage apparatus having massage pressure sensing and adapting drive mechanism.

BACKGROUND OF THE INVENTION

At present, all the massage devices on the market, like massage chair or massage bed, can adjust the massage pressure or frequency, but it has to use the rotary gear knob on the massage device manually to adjust the massage pressure, and there are only two 2 or 3 gears for the user to choose. Further more, human body must adapt to the massage device to get the the massage service from the existing massage devices, and will have rigid feelings during the operation. Although the massage head of some massage device can extend back and forward, but it can only change the front and back position by power or hand. In addition, the users usually have different body types, but the massage heads of the existing massage devices can only provide a fixed stroke, and can only change the stroke when the gear is changed. But the existing massage devices can provide only a few pressure adjusting gears which can not be adjusted automatically according to different body types of the users, therefore the existing massage devices can not adapt to all users, and there is some inconvenience even for a individual user.

SUMMARY OF THE INVENTION

It is therefore the object of the present invention to overcome the above-mentioned problem, and provide a massage apparatus having massage pressure sensing and adapting drive mechanism.

The massage apparatus having massage pressure sensing and adapting drive mechanism comprises a movable base frame, massage mechanism and pressure sensing and adapting drive mechanism, the massage mechanism and pressure sensing and adapting drive mechanism are provided on the movable base frame.

The massage mechanism comprises the left and right clamp plates, linking post, malaxation part and pummeling part.

The left and right clamp plates are rotatably set on the movable base frame. The linking post is provided between the left and right clamp plates. The arc racks are provided respectively on one end of the left and right clamp plates.

The malaxation part is set between the left and right clamp plates, including the malaxation shaft, eccentric wheel, left and right massage arms, massage head, pulley, and electric motor. Therein, the malaxation shaft is fixedly set between the left and right clamp plates. Two eccentric wheels are installed on the malaxation shaft. The two eccentric wheels are respectively set with massage arms on which the massage head is installed rotatably. The turbine is installed on one end of the malaxation shaft, the worm is provided on the turbine, the pulley is installed on the worm, and the pulley is connected to the electric motor by a belt.

The pummeling part is provided between the left and right clamp plates, including the pummeling shaft, eccentric bushing, pummeling shaft bearing block, bulb headed screw, pulley and motor. The pummeling shaft is rotatably provided between the left and right clamp plates. Two eccentric bushings are installed on the pummeling shaft, the pummeling bearing blocks are respectively provided on the two eccentric bushings, and the bulb headed screws are respectively connected to the two pummeling bearing blocks. The bulb heads of the two bulb headed screws are respectively linked to the massage arms. One end of the pummeling shaft is set with a pulley, and the pulley is connected to the electric motor by a belt.

Two bearing supports are set on the movable base frame, the bearing blocks are provided respectively on the two supports, the two bearing blocks are set with bearings respectively, and the rotating shaft is set on the two bearings. Two gears are provided on the rotating shaft, the two gears are meshed with the arc racks on the left and right clamp plates respectively.

The pressure sensing and adapting drive mechanism comprises a large pulley, a pulley, an electric motor, a pressure sensing and adapting drive. The electric motor is connected to the pulley by a belt, the pulley is connected to the pressure sensing and adapting drive, the pressure sensing and adapting drive is connected to the large pulley by a belt, and the large pulley is connected to the rotating shaft.

The pressure sensing and adapting drive comprises a bearing block, a bearing, a rotating shaft, a driving impeller, a driven impeller, an impeller shroud, seals, and a pulley. The two bearing blocks are set on the movable base frame, the bearings are respectively installed on the two bearing blocks, the rotating shaft is provided on the two bearings, and one end of the rotating shaft is connected with a pulley. The driving impeller, driven impeller, and driven impeller shroud are further provided on the rotating shaft. Thereinto, the driven impeller and driven impeller shroud are buckled with each other to form a closed cavity in which the liquid is provided. The driving impeller is provided on the rotating shaft within the cavity. A pulley is provided at the outer end of the driven impeller, and the pulley is connected to the large pulley by a belt.

The massage apparatus having pressure sensing and adapting drive mechanism of the present invention works by following mode:

The electric motor works to drive the rotation of the pulley, the pulley drives the rotation of the rotating shaft to get the driving impeller to rotate, the centrifugal pressure produced by the rotation of the driving impeller will drive the stream of the liquid within the closed cavity, the stream direction is the same with the rotating direction of the driving impeller. The liquid stream drives the driven impeller to rotate, which drives the rotation of the pulley, and the pulley drives the large pulley to rotate by a belt. As the large pulley is connected the rotating shaft, the rotation of the large pulley drives the rotation of the rotating shaft, driving the movement of the left and right clamp plates by the gears installed on the rotating shaft, and forms a massage system which can not only provide left and right malaxation and pummeling service, but also provide elastic massage back and forth.

The massage apparatus having pressure sensing and adapting drive mechanism of the present invention follows the following working principle:

As the malaxation part and pummeling part are set on the left and right clamp plates, the working stroke of the malaxation part and pummeling part is completely controlled by the working stroke of the left and right clamp plates, while the working stroke of the left and right clamp plates is controlled by the pressure sensing and adapting drive. When the pressure sensing and adapting drive begins to work, the massage head stretches to the limit point forward. Change the forward stretch strength of the massage head by changing the rotating speed of the motor, the forward stretch force is the strength of the massage head used to touch human body. When the forward stretch force is set (the forward stretch force will be set at the place where the button for the user is fixed). During the application, when the loading force is smaller than the forward stretch force, the electric motor rotates clockwise and drive the driving impeller to rotate clockwise, getting the driven impeller to rotate clockwise, which make the left and right clamp plates rotate move, and the left and right clamp plates get the massage head to stretch forward. When the loading force is equal to the forward stretch force, the driven impeller stops rotating and gets the massage head stops stretching forward. When the body type of the user is changed, e.g. the back curve of human body is changed, the loading force may be bigger than the forward stretch force, and when the loading force is larger than the forward stretch force, the loading force will pressure the driven impeller to rotate anticlockwise, getting the massage head to move backward, til the loading force is equal to the forward stretch force.

The massage apparatus having a pressure sensing and adapting drive mechanism of the present invention is mainly used for massage chair or massage bed. It can feel the massage pressure automatically, and can adjust the massage pressure within the setting pressure range automatically in real time according to different body types of the users. The massage apparatus can automatically adapt to changes in the height and the curvature of the back of human body in the course of massaging, performing manipulation, malaxation, pummeling and finger pressure massage on a person of anybody type, and the massage pressure can be set freely. The user leans his back on the back of the massage chair or lies on the back of the chair. The back of the chair supports the user's body, then the apparatus can provide real-time massage to the user's back according to the massage procedures and pressure set by the user, and the massage pressure can be adjusted, realizing that the machine automatically adapts to body type to provide pleasant massage service. This totally change the rigid keenly feel of the existing massage chair which provides massage service by using the massage head to support human back.

DETAILED DESCRIPTION OF THE INVENTION

The following will further describe the invention in details by combining with the drawings, but it will not intended to limit the scope of the present invention.

Figure 1:
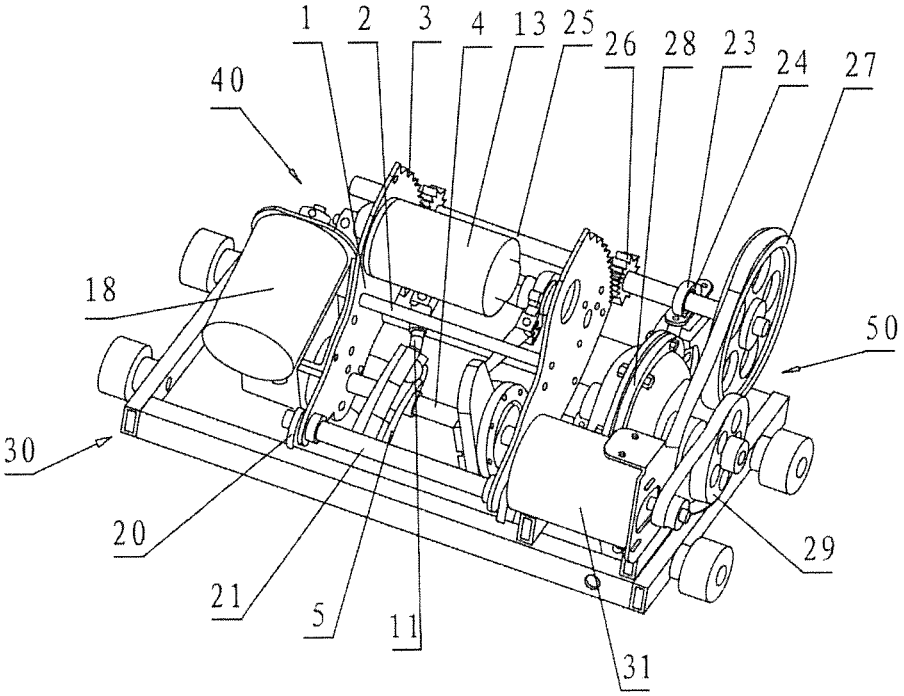
FIG. 1 is a structure diagram of a massage apparatus having massage pressure sensing and adapting drive mechanism for a preferred embodiment of the present invention.
Figure 2:
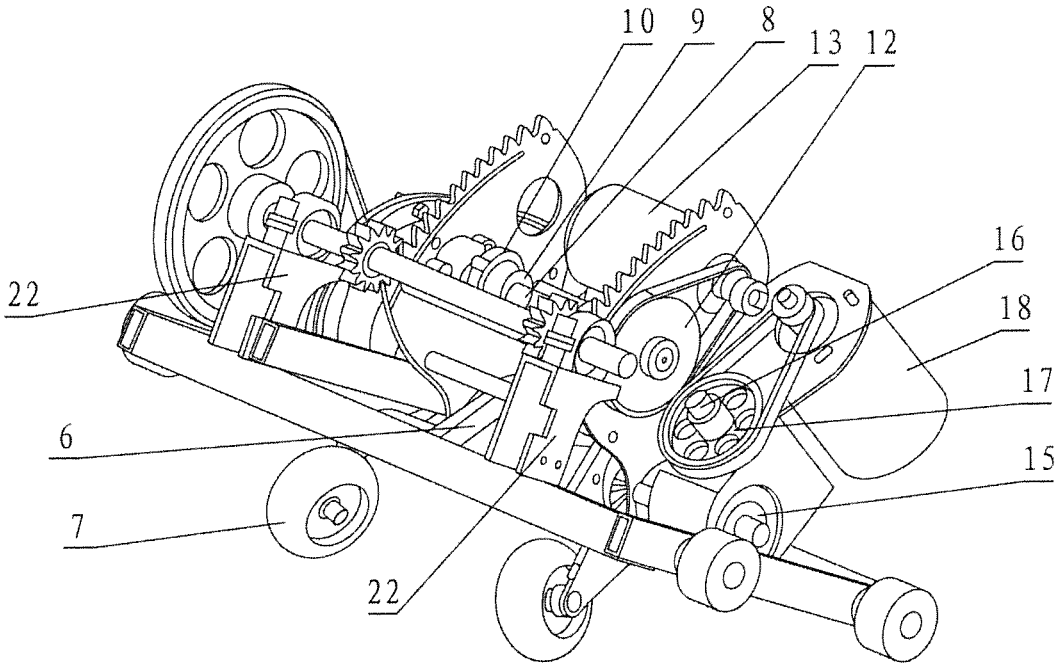
FIG. 2 is a structure diagram from another perspective of a massage apparatus having massage pressure sensing and adapting drive mechanism for a preferred embodiment of the present invention.
Figure 3:
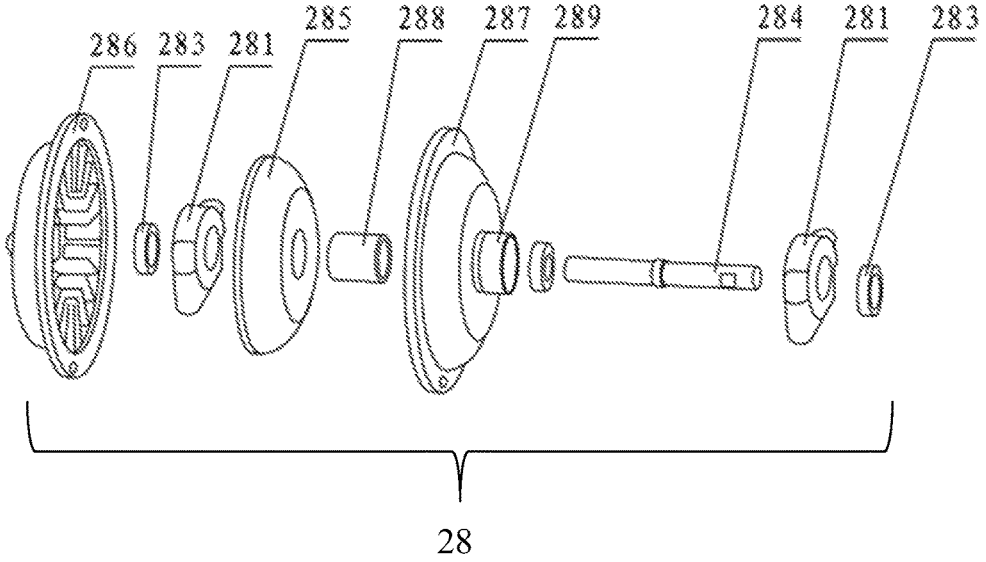
FIG. 3 is a decomposition diagram of a massage pressure sensing and adapting drive mechanism for a preferred embodiment of the present invention.

As shown in FIG. 1, FIG. 2 and FIG. 3, the massage apparatus of the present invention having a massage pressure sensing and adapting drive mechanism comprises the movable frame 30 at the bottom, the massage mechanism 40 and the pressure sensing and adapting drive mechanism 50.

As shown in FIG. 1 and FIG. 2, the movable frame 30 is a bread holder type, the massage mechanism 40 and the pressure sensing and adapting drive mechanism 50 are provided on the movable base frame 30.

The massage mechanism 40 comprises the left and right clamp plates 1, the linking post 2, the malaxation part and pummeling part.

The lower end of the left and right clamp plates 1 is rotatably provided on one border of the movable base frame 30. A hole is provided on the lower end of the left and right clamp plates 1, two fixed riser plates 20 are provided one border of the movable base frame 30, there is also a hole on the fixed riser plate 20 which is corresponding with the hole on the lower end of the left and right clamp plates 1, the locating shaft 21 goes through the left and right clamp plates 1 and the hole on the fixing riser plate 20, fixing the left and right clamp plates 1 on the base frame 30.

The linking post 2 is provided between the left and right clamp plates 1. The linking post 2 is used to fix the left and right clamp plates 1.

One end of the left and right clamp plates 1 is set with arc racks 3 which are molded in one body with clamp plates.

The malaxation part is set between the left and right clamp plates 1, including malaxation shaft 4, centrifugal wheel 5, left and right massage arms 6, massage head 7, pulley 17, and electric motor 18. Thereinto, the malaxation shaft 4 is fixed between the left and right clamp plates 1. Two eccentric wheels 5 are installed on the malaxation shaft 4, the massage arms 6 are respectively provided on the two eccentric wheels 5, and the massage head 7 is rotatably installed on massage arms 6. The massage head 7 is a roller in this embodiment. The turbine 15 is installed on one end of the malaxation shaft 4, the worm 16 is provided on the turbine 15, the pulley 17 is installed on the worm 16, and the pulley 17 is connected to the electric motor 18 by a belt. The electric motor 18 is working to drive the rotation of the malaxation shaft 4 by the turbine 15 and the worm 16, so as to drive the rotation of the massage head 7.

The pummeling part is provided between the left and right clamp plates 1, including the pummeling shaft 8, eccentric bushing 9, pummeling bearing block 10, bulb-headed screw 11, pulley 12 and electric motor 13. The pummeling shaft 8 is rotatably provided between the left and right clamp plates 1. Two eccentric bushings 9 are installed on the pummeling shaft 8, the pummeling bearing blocks 10 are respectively on the two eccentric bushings 9, and the bulb-headed screws 11 are respectively provided on the two pummeling bearing blocks 10. The bulbs of the two bulb-headed screws are connected to the massage arm 6 respectively. The pulley 12 is installed on one end of the pummeling shaft 8, and the pulley 12 is connected to the electric motor 13 by a belt. When the electric motor 13 is working, it will drive the rotation of the pummeling shaft 8 by the pulley 12, so as to drive the movement of the two bulb-headed screws which are installed on the pummeling shaft 8.

As shown in FIG. 1 and FIG. 2, the pressure sensing and adapting drive mechanism 50 is set on the movable frame 30. Two bearing supports 22 are provided on one border of the movable base frame 30, the bearing blocks 23 are respectively provided on the two supports 22, the bearings 24 are respectively provided on the two bearing blocks 23, and the rotating shaft 25 is arranged on the two bearings 24. Two gears 26 are set on the rotating shaft 25, and the two gears 26 respectively engage with the arc racks 3 of the left and right clamp plates.

The pressure sensing and adapting drive mechanism 50 comprises the large pulley 27, pulley 29, electric motor 31 and pressure sensing and adapting drive 28. The electric motor 31 is connected to the pulley 29 by a belt, the pulley 29 is connected to the pressure sensing and adapting drive 28, the drive 28 is connected to the large pulley 27 by a belt, and the large pulley 27 is connected to the rotating shaft 25.

As shown in FIG. 3, the pressure sensing and adapting drive 28 comprises the bearing block 28, bearing 283, rotating shaft 284, driving impeller 285, driven impeller 286, driven impeller shroud 287, seal 288 and pulley 289. The two bearing blocks are set on the movable base frame 30, the bearings 283 are respectively provided on the two bearing blocks 281, the rotating shaft 284 is set on the two bearings 283, and one end of the rotating shaft is connected to the pulley 28. The driving impeller 285, the driven impeller 286 and the driven impeller shroud 287 are further provided on the rotating shaft 284. Thereinto, the driven impeller 286 and the driven impeller shroud 287 are meshed with each other to form a closed cavity in which there is some liquid. In this embodiment, the liquid is oil, of course, other liquid like water will be ok. The driving impeller 285 is set on the rotating shaft 284 within the cavity. The pulley 289 is provided on the outer end of the driven impeller 286, and the pulley 289 is connected to the large pulley 27 by a belt.

The massage apparatus having a pressure sensing and adapting drive mechanism of the present invention works by following mode: the motor 31 works to drive the rotation of the pulley 29, the pulley 29 drive the rotation if the rotating shaft 284, so as to drive the rotation of the driving impeller 285. The centrifugal pressure produced by the rotation of the driving impeller 285 will drive the flow of the liquid within the closed cavity. The flow direction is the same with the rotating direction of the driving impeller 285. The liquid flow drives the rotation of the driving impeller 286 so as to drive the rotation of the pulley 289. The pulley 289 will drive the rotation of the large pulley 27 by a belt. Because the large pulley 27 is connected to the rotating shaft 25, the rotation of the large pulley will drive the rotation of the rotating shaft 25, so as to drive the movement of the left and right clamp plates 1 by the gears 26 installed on the rotating shaft 25, forming a massage system which can not only provide left and right maxalation and pummeling service, but also offer back and forward massage.

The working principle of the massage apparatus having a pressure sensing and adapting drive mechanism of the present invention is as follows:

As both the malaxation part and pummeling part are provided on the left and right clamp plates 1, the working stroke of the malaxation part and pummeling part is completely controlled by the working stroke of the left and right clamp plates 1. While the working stroke of the left and right clamp plates is controlled by the pressure sensing and adapting drive 28. Take the massage head as an example, when the pressure sensing and adapting drive 28 begins to work, the massage head 7 will stretch forward to the limit point. Change the forward stretch force of the massage head 7 by changing the rotation of the electric motor, and the forward stretching pressure is the pressure of the massage head to touch human body. The forward stretch force is related with the rotation of the electric motor. The higher the rotating speed is, the bigger of the forward stretch force is, or vice versa. The forward stretch force is set beforehand. Usually two parameters will be set, one is the lowest rotating speed of the motor which is corresponding with the minimum forward stretch force, the other is the highest rotating speed of the motor which is corresponding with the biggest forward stretch force. The user can adjust the settings of the two parameters by turning up and turning down (or the smallest or biggest) freely (it can be controlled by the rotary button on the massage apparatus), til the user feel comfortable.

The loading force is defined as the resistance encountered by the massage head 7 when it offers massage to human body, and the loading force will be different between different body types. When the forward stretch force is set (the forward stretch force will be set where the user's rotary button is located), during the application, if the loading force is smaller than the forward stretch force, the motor 31 will rotate clockwise and drive the driving impeller 285 to rotate clockwise, and get the driven impeller 286 to rotate clockwise, so as to drive the movement of the left and right clamp plates 1, and the left and right clamp plates 1 will drive the massage head 7 to stretch forward. When the loading force is equal to the forward stretch force, the driven impeller 286 will stop rotating, so that the massage head 7 will stop stretching forward. If the user's body type changes, such as the back curve changes, the loading force might be bigger than the forward stretch force. When the loading force is bigger than the forward stretch, the driven impeller 286 will also rotate anti-clockwise (forced by the loading force), so as to drive the massage head 7 to draw back til the loading force is equal to the forward stretch force.

The massage apparatus having a pressure sensing and adapting drive mechanism of the present invention is mainly used for massage chair or massage bed. It can feel the massage pressure automatically, and can adjust the massage pressure within the setting pressure range automatically in real time according to different body types of the users. The massage apparatus can automatically adapt to changes in the height and the curvature of the back of human body in the course of massaging, performing manipulation, malaxation, pummeling and finger pressure massage on a person of anybody type, and the massage pressure can be set freely. The user leans his back on the back of the massage chair or lies on the back of the chair. The back of the chair supports the user's body, then the apparatus can provide real-time massage to the user's back according to the massage procedures and pressure set by the user, and the massage pressure can be adjusted, realizing that the machine automatically adapts to body type to provide pleasant massage service. This totally change the rigid keenly feel of the existing massage chair which provides massage service by using the massage head to support human back.

While a particular embodiment of the invention has been shown and described, it will be obvious to those skilled in the art that changes and modifications can be made without departing from the true spirit and scope of the invention. It should be understood that the embodiments of the present invention described above are illustrative only, and all the changes and modifications made by those skilled in the art are covered by the appended claims.

What is claimed is:

1. A massage apparatus comprising:

a movable base frame (30), a massage mechanism (40) and a pressure sensing and adapting drive mechanism (50); the massage mechanism (40) and the pressure sensing and adapting drive mechanism (50) are provided on the movable base frame (30).

2. The massage apparatus according to claim 1, wherein the massage mechanism (40) includes a left and right clamp plates (1), a malaxation part and a pummeling part; the left and right clamp plates (1) are fixedly provided on the movable base frame (30); and the malaxation part and pummeling part are provided between the left and right clamp plates (1); two bearing supports (22) are provided on the movable base frame (30), a bearing block (23) is provided on each of the two bearing supports (22), a bearing (24) is installed on each of the two bearing blocks (23), and a rotating shaft (25) is provided on the two bearings (24); two gears (26) are provided on the rotating shaft (25), and the two gears (26) mesh with an arc rack (3) on the left and right clamp plates (1).

* * * * *